US009032654B2

(12) United States Patent
Wilcoxen et al.

(10) Patent No.: US 9,032,654 B2
(45) Date of Patent: May 19, 2015

(54) SHADOW BOX TRADING CARD

(75) Inventors: Wayne Wilcoxen, Carlsbad, CA (US); Martin Welling, Murrieta, CA (US)

(73) Assignee: THE UPPER DECK COMPANY, Cheyenne, NV (US)

( * ) Notice: Subject to any disclaimer, the term of this patent is extended or adjusted under 35 U.S.C. 154(b) by 188 days.

(21) Appl. No.: 12/877,976

(22) Filed: Sep. 8, 2010

(65) Prior Publication Data

US 2011/0078932 A1 Apr. 7, 2011

Related U.S. Application Data

(60) Provisional application No. 61/240,704, filed on Sep. 9, 2009.

(51) Int. Cl.

| | |
|---|---|
| ***B42D 15/04*** | (2006.01) |
| ***A63F 1/02*** | (2006.01) |
| *A63F 1/06* | (2006.01) |
| *A63F 9/06* | (2006.01) |

(52) U.S. Cl.

CPC . *A63F 1/02* (2013.01); *B42D 15/04* (2013.01); *A63F 1/062* (2013.01); *A63F 2009/062* (2013.01); *A63F 2250/305* (2013.01)

(58) Field of Classification Search

CPC ..... G09F 1/04; G09F 13/00; G09F 13/02; B42D 15/04; B41M 3/00

USPC ..... 40/765, 675, 800; 206/449, 453, 454, 206/446, 725, 485

See application file for complete search history.

(56) References Cited

U.S. PATENT DOCUMENTS

| | | | | | |
|---|---|---|---|---|---|
| 1,244,959 | A | * | 10/1917 | Conover | 40/444 |
| 2,151,055 | A | * | 3/1939 | Stark | 428/14 |
| 3,314,180 | A | * | 4/1967 | Porter | 40/743 |
| 3,790,772 | A | * | 2/1974 | Newman et al. | 40/444 |
| 4,290,530 | A | | 9/1981 | Wooster | |
| 4,779,752 | A | * | 10/1988 | Vallee et al. | 220/533 |
| 4,979,324 | A | | 12/1990 | Rehtmeyer et al. | |
| 5,096,752 | A | | 3/1992 | Wagner | |
| 5,237,763 | A | | 8/1993 | Ochoa | |
| D415,218 | S | * | 10/1999 | Corliss | D21/506 |

(Continued)

FOREIGN PATENT DOCUMENTS

| | | | |
|---|---|---|---|
| DE | 20309718 | C2 | 9/2003 |
| DE | 20309718 | U1 * | 9/2003 |
| JP | 2007102147 | A * | 4/2007 |

*Primary Examiner* — Casandra Davis

(74) *Attorney, Agent, or Firm* — Roeder & Broder LLP

(57) ABSTRACT

A trading card (10) comprises a first substrate (14A), a second substrate (14B) and a spacer (16A). The first substrate (14A) includes a first card image (18). The second substrate (14B) includes a second card image (20). The second substrate (14B) is spaced apart from the first substrate (14A). The spacer (16A) is positioned substantially between the first substrate (14A) and the second substrate (14B) to maintain the first card image (18) spaced apart from the second card image (20). The trading card (10) can further comprise a third substrate (14C) and a second spacer (16B). The third substrate (14C) includes a third card image (22). The third substrate (14C) is spaced apart from the first substrate (14A) and the second substrate (14B). The second spacer (16B) is positioned substantially between the second substrate (14B) and the third substrate (14C) to maintain the second card image (20) spaced apart from the third card image (22). The first card image (18), the second card image (20) and the third card image (22) can cooperate to form a full card image (12).

15 Claims, 5 Drawing Sheets

(56) References Cited

U.S. PATENT DOCUMENTS

| | | | | |
|---|---|---|---|---|
| 6,023,867 | A | 2/2000 | Gagne | |
| 6,052,932 | A | 4/2000 | Reddig et al. | |
| 6,061,938 | A | 5/2000 | Young | |
| 6,490,818 | B1 | 12/2002 | Bramhall et al. | |
| 6,553,704 | B1 * | 4/2003 | Pigg | 40/734 |
| 7,413,128 | B2 | 8/2008 | Waldo et al. | |
| 2006/0043679 | A1 | 3/2006 | Fallon et al. | |
| 2006/0086019 | A1 | 4/2006 | Wilcoxen et al. | |

* cited by examiner

SHADOW BOX TRADING CARD

RELATED APPLICATION

This application claims the benefit on U.S. Provisional Application Ser. No. 61/240,704 filed on Sep. 9, 2009. The contents of U.S. Provisional Application Ser. No. 61/240,704 are incorporated herein by reference.

BACKGROUND

Trading cards are a popular way to collect images and information about athletes and celebrities. Unfortunately, many of the trading cards are manufactured in large quantities and are not very unique. Further, existing trading cards do not provide the ability to adequately show depth or dimension to the included trading card images.

SUMMARY

The present invention is directed to a trading card comprising a first substrate, a second substrate and a spacer. The first substrate includes a first card image. The second substrate includes a second card image. The second substrate is spaced apart from the first substrate. The spacer is positioned substantially between the first substrate and the second substrate to maintain the first card image spaced apart from the second card image.

In some embodiments, the first card image and the second card image cooperate to form a full card image. In one such embodiment, the first card image is different than the second card image. In another such embodiment, the first card image is substantially similar to the second card image.

In certain embodiments, the spacer is substantially frame shaped. In such embodiments, an outer edge of the spacer can be substantially similar in size and shape to an outer edge of the first substrate and an outer edge of the second substrate.

In some embodiments, the trading card further comprises a third substrate and a second spacer. The third substrate includes a third card image. The third substrate is spaced apart from the first substrate and the second substrate. The second spacer is positioned substantially between the second substrate and the third substrate to maintain the second card image spaced apart from the third card image. In one such embodiment, the first card image, the second card image and the third card image cooperate to form a full card image. In another such embodiment, the first card image, the second card image and the third card image are different from one another.

In one embodiment, the trading card further comprises a box including a base, a first side, a second side, a first end, and a second end. In such embodiment, the first substrate and the second substrate are contained substantially within the box. Additionally, in one embodiment, the first side, the second side, the first end and the second end can pivot relative to the base between an unassembled configuration and an assembled configuration. In another embodiment, at least two of the first side, the second side, the first end and the second end include a support ledge. In such embodiment, the support ledges cooperate to form the spacer to maintain the first substrate spaced apart from the second substrate.

Additionally, the present invention is also directed to a method for making a trading card.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1A:
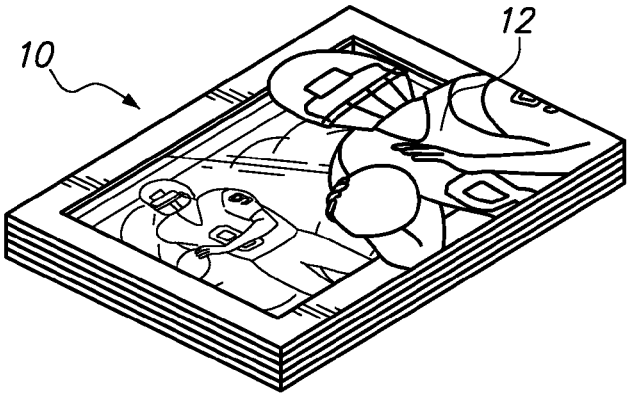
FIG. 1A is a perspective view of one embodiment of a trading card having features of the present invention.

FIG. 1A is a perspective view of one embodiment of a trading card 10 having features of the present invention. The size and shape of the trading card 10 and the various components of the trading card 10 can be varied to suit the desired design requirements of the trading card 10.

In some embodiments, the trading card 10 is generally rectangular shaped and has a length of between 2 and 6 inches, a width of between approximately 1.5 and 4.0 inches, and a thickness of between approximately 0.125 and 0.5 inches. For example, the trading card 10 can have the same approximate cross-sectional area of a standard trading card having a length of approximately 3.5 inches, and a width of approximately 2.5 inches. Alternatively, the trading card 10 can have a different shape and/or have a different size. In certain embodiments, for example, the trading card 10 can be generally square shaped, circle shaped, oval shaped, hexagon shaped, or some other shape, and/or the trading card 10 can have dimensions that are greater than or less than those provided above.

As an overview, the trading card 10, as taught in the present invention, provides a full card image 12 that includes a plurality of individual card images so as to exhibit increased depth and dimension as compared to a standard trading card. In particular, the trading card 10 is uniquely designed so that at least one of the individual card images is spaced apart from each of the other individual card images. Moreover, in certain embodiments, each of the individual card images is spaced apart from each of the other individual card images. The amount of depth and dimension that is exhibited by the trading card 10 corresponds, at least in part, to the overall thickness of the trading card 10.

Figure 1B:
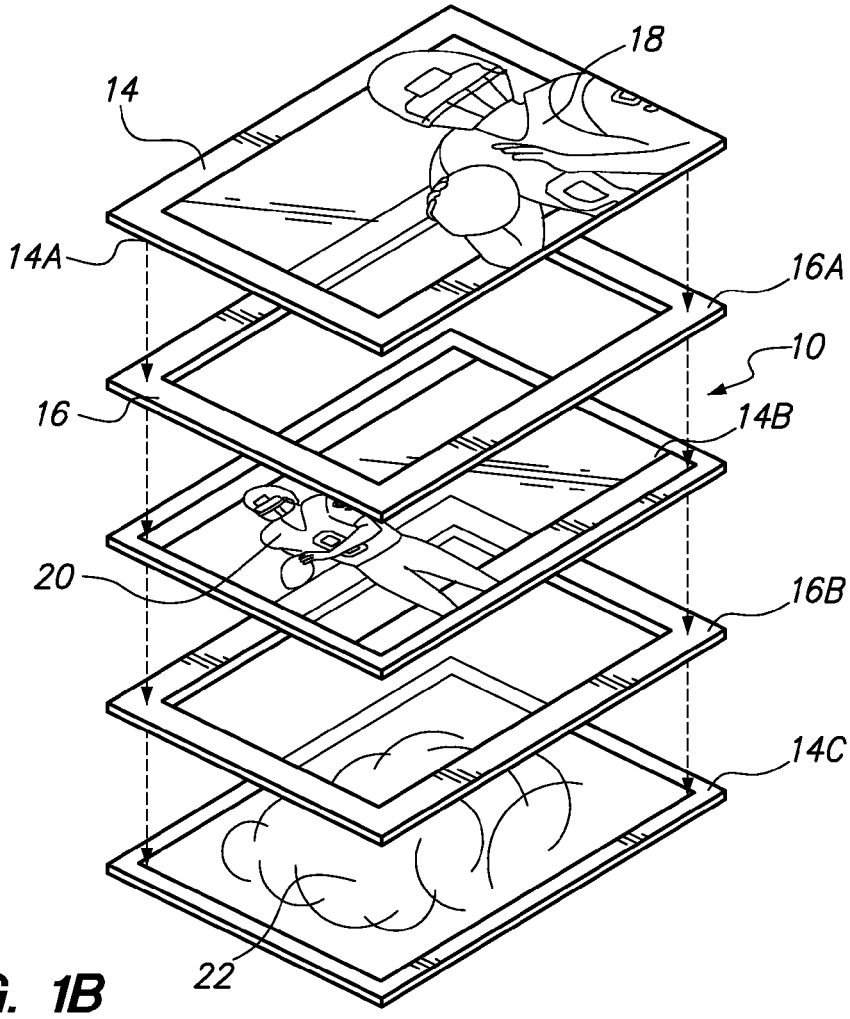
FIG. 1B is an exploded view of the trading card illustrated in FIG. 1A.

FIG. 1B is an exploded view of the trading card 10 illustrated in FIG. 1A. As illustrated, the trading card 10 includes a plurality of substrates 14 wherein each substrate 14 is spaced apart from each of the other substrates 14 by one or more spacer layers 16 (sometimes also referred to herein simply as "spacers"). In the embodiment shown in FIG. 1B, the trading card 10 includes three substrates 14 and two spacer layers 16. Alternatively, the trading card 10 can be designed to include only two substrates 14 or more than three substrates 14. For example, the trading card 10 can be designed to include five substrates 14, seven substrates 14, nine substrates 14 or some other number of substrates 14. Still alternatively, the trading card 10 can be designed to include only one spacer layer 16 or more than two spacer layers 16. For example, the trading card 10 can be designed to include four spacer layers 16, six spacer layers 16, eight spacer layers 16, or some other number of spacer layers 16.

In this embodiment, the trading card 10 includes (i) a first substrate 14A having a first card image 18, (ii) a second substrate 14B having a second card image 20, (iii) a third substrate 14C having a third card image 22, (iv) a first spacer layer 16A that is positioned substantially between the first substrate 14A and the second substrate 14B so that the first substrate 14A is maintained spaced apart from the second substrate 14B, and (v) a second spacer layer 16B that is positioned substantially between the second substrate 14B and the third substrate 14C so that the second substrate 14B is maintained spaced apart from the third substrate 14C.

As illustrated, the substrates 14A, 14B, 14C and the spacer layers 16A, 16B are positioned relative to each other from front to back in the finished trading card 10 (as illustrated in FIG. 1A) in the order of the first substrate 14A, the first spacer layer 16A, the second substrate 14B, the second spacer layer 16B, and the third substrate 14C. Alternatively, the substrates 14A, 14B, 14C and the spacer layers 16A, 16B can be positioned in a different order relative to each other so long as there is at least one spacer layer 16A, 16B positioned between each substrate 14A, 14B, 14C and each of the other substrates 14A, 14B, 14C.

It should be noted that the use of the terms first substrate, second substrate and third substrate are used merely for reasons of convenience of description, and any of the substrates 14A, 14B, 14C can be considered to be the first substrate, the second substrate and the third substrate. Somewhat similarly, it should be noted that the use of the terms first spacer layer and second spacer layer are used merely for reasons of convenience of description, and any of the spacer layers 16A, 16B can be considered to be the first spacer layer and the second spacer layer.

In certain embodiments, the first substrate 14A is a substantially transparent, generally rectangular shaped substrate that includes the first card image 18. The first substrate 14A can be made from PVC, clear plastic or some other transparent material. In one embodiment, the first substrate 14A can have the same approximate cross-sectional area of a standard trading card having a length of approximately 3.5 inches, and a width of approximately 2.5 inches. Additionally, the first substrate 14A can have a thickness of between approximately 0.5 mm and 1.5 mm. Alternatively, the first substrate 14A can have a length, a width and a thickness that are greater than or less than the dimensions listed above, and/or the first substrate 14A can have a different shape. In certain embodiments, for example, the first substrate 14A can be generally square shaped, circle shaped, oval shaped, hexagon shaped, or some other shape.

The first card image 18 is positioned on the first substrate 14A. In different embodiments, the first card image 18 can cover some, most, or the entire surface of the first substrate 14A, and can be positioned at any location on the surface of the first substrate 14A. In certain non-exclusive examples, the first card image 18 can include all or a portion of a sports athlete, a celebrity, an entertainer, statistics, a team logo, a game field or arena, an image used in a game, an animated character, an autograph, an animal or landscape.

In some embodiments, the second substrate 14B is substantially similar in size, shape and design to the first substrate 14A. For example, the second substrate 14B can be a substantially transparent, generally rectangular shaped substrate that includes the second card image 20. Alternatively, the second substrate 14A can have a length, a width and a thickness that are greater than or less than the dimensions of the first substrate 14A, and/or the second substrate 14A can have a different shape than the first substrate 14A. In certain embodiments, for example, the second substrate 14B can be generally square shaped, circle shaped, oval shaped, hexagon shaped, or some other shape.

The second card image 20 is positioned on the second substrate 14B. In different embodiments, the second card image 20 can cover some, most, or the entire surface of the second substrate 14B, and can be positioned at any location on the surface of the second substrate 14B. In certain non-exclusive examples, the second card image 20 can include all or a portion of a sports athlete, a celebrity, an entertainer, statistics, a team logo, a game field or arena, an image used in a game, an animated character, an autograph, an animal or landscape. In different embodiments, the second card image 20 can be different than the first card image 18 or the second card image 20 can be substantially similar to the first card image 18. Moreover, the first card image 18 and the second card image 20 can be related in some fashion. For example, the first card image 18 and the second card image 20 can be of the same individual or character, can include individuals on the same team, and/or can be approximately the same size. Still alternatively, one of the card images 18, 20 can be an individual and the other card image 20, 18 a team logo for the team that the individual plays for. Yet alternatively, in certain non-exclusive examples, the card images 18, 20 can cooperate to form a single combined image, i.e. the full card image 12 (illustrated in FIG. 1A), of a sports athlete, a celebrity, an entertainer, statistics, a team logo, a game field or arena, an image used in a game, an animated character, an autograph, an animal or landscape. In such embodiments, each card image 18, 20 can include a portion of the single combined image. Further, in certain embodiments, the different card images are located at different locations on the respective substrate.

In some embodiments, the third substrate 14C is substantially similar in size, shape and design to the first substrate 14A and the second substrate 14B. For example, the third substrate 14C can be a substantially transparent, generally rectangular shaped substrate that includes the third card image 22. Alternatively, the third substrate 14C can have a length, a width and a thickness that are greater than or less than the dimensions of the first substrate 14A and the second substrate 14B, and/or the third substrate 14C can have a different shape than the first substrate 14A and the second substrate 14B. In certain embodiments, for example, the third substrate 14C can be generally square shaped, circle shaped, oval shaped, hexagon shaped, or some other shape. Still alternatively, the third substrate 14C, i.e. the back substrate or bottom substrate in this particular embodiment, need not be substantially transparent.

The third card image 22 is positioned on the third substrate 14C. In different embodiments, the third card image 22 can cover some, most, or the entire surface of the third substrate 14C, and can be positioned at any location on the surface of the third substrate 14C. In certain non-exclusive examples, the third card image 22 can include all or a portion of a sports athlete, a celebrity, an entertainer, statistics, a team logo, a game field or arena, an image used in a game, an animated character, an autograph, an animal or landscape. In different embodiments, the third card image 22 can be different than the first card image 18 and the second card image 20, or the third card image 22 can be substantially similar to one or more of the first card image 18 and the second card image 20. Moreover, each of the card images 18, 20, 22 can be related in some fashion. For example, the card images 18, 20, 22 can be of the same individual or character, can include individuals on the same team, and/or can be approximately the same size. Still alternatively, one of the card images 18, 20, 22 can be an individual, one of the card images 18, 20, 22 can be a team logo for the team that the individual plays for, and one of the card images 18, 20, 22 can include a landscape on which the individual performs. Yet alternatively, in certain non-exclusive examples, the card images 18, 20, 22 can cooperate to form a single combined image, i.e. the full card image 12, of a sports athlete, a celebrity, an entertainer, statistics, a team logo, a game field or arena, an image used in a game, an animated character, an autograph, an animal or landscape. In such embodiments, each card image 18, 20, 22 can include a portion of the single combined image.

As illustrated in FIG. 1B, the first spacer layer 16A is positioned substantially between the first substrate 14A and the second substrate 14B so as to maintain the first substrate 14A completely spaced apart from the second substrate 14B. Moreover, the first spacer layer 16A is positioned substantially between the first substrate 14A and the second substrate 14B so as to maintain the first card image 18 completely spaced apart from the second card image 20. Additionally, the first spacer layer 16A is fixedly secured to the first substrate 14A and the second substrate 14B when the trading card 10 is completely formed, as illustrated in FIG. 1A.

In the embodiment illustrated in FIG. 1B, the first spacer layer 16A is substantially rectangular frame shaped and is made from one or more layers of card stock. In some embodiments, the size and shape of the first spacer layer 16A is designed so that the outer edge of the first spacer layer 16A has a length and width that are substantially similar to the length and width of the first substrate 14A and the second substrate 14B. With this design, the first spacer layer 16A can easily be fixedly secured to both the first substrate 14A and the second substrate 14B to create a smooth outer edge for the trading card 10. In different embodiments, the first spacer layer 16A can be fixedly secured to the first substrate 14A and the second substrate 14B with glue, magnets, or by some other means. In certain alternative embodiments, the first spacer layer 16A can be designed so that the outer edge of the first spacer layer 16A has a different size and/or shape as compared to the first substrate 14A and/or the second substrate 14B. Still alternatively, the first spacer layer 16A can be made from a material other than card stock.

The thickness of the first spacer layer 16A can be varied depending on the amount of depth and dimension that is desired to be generated between the first substrate 14A and the second substrate 14B. In different embodiments, the first spacer layer 16A can have a thickness of between approximately 1.0 mm and 3.0 mm. Alternatively, the first spacer layer 16A can have a thickness that is greater than 3.0 mm or less than 1.0 mm.

In some embodiments, the second spacer layer 16B is substantially similar in size, shape and design to the first spacer layer 16A. As illustrated in FIG. 1B, the second spacer layer 16B is positioned substantially between the second substrate 14B and the third substrate 14C so as to maintain the second substrate 14B completely spaced apart from the third substrate 14C. Moreover, the second spacer layer 16B is positioned substantially between the second substrate 14B and the third substrate 14C so as to maintain the second card image 20 completely spaced apart from the third card image 22. Additionally, the second spacer layer 16B is fixedly secured to the second substrate 14B and the third substrate 14C when the trading card 10 is completely formed, as illustrated in FIG. 1A.

In the embodiment illustrated in FIG. 1B, the second spacer layer 16B is substantially rectangular frame shaped and is made from one or more layers of card stock. In some embodiments, the size and shape of the second spacer layer 16B is designed so that the outer edge of the second spacer layer 16B has a length and width that are substantially similar to the length and width of the second substrate 14B and the third substrate 14C. With this design, the second spacer layer 16B can easily be fixedly secured to both the second substrate 14B and the third substrate 14C to create a smooth outer edge for the trading card 10. In different embodiments, the second spacer layer 16B can be fixedly secured to the second substrate 14B and the third substrate 14C with glue, magnets, or by some other means. In certain alternative embodiments, the second spacer layer 16B can be designed so that the outer edge of the second spacer layer 16B has a different size and/or shape as compared to the second substrate 14B and/or the third substrate 14C. Still alternatively, the second spacer layer 16B can be made from a material other than card stock.

The thickness of the second spacer layer 16B can be varied depending on the amount of depth and dimension that is desired to be generated between the second substrate 14B and the third substrate 14C. In different embodiments, the second spacer layer 16B can have a thickness of between approximately 1.0 mm and 3.0 mm. Alternatively, the second spacer layer 16B can have a thickness that is greater than 3.0 mm or less than 1.0 mm. In different embodiments, the second spacer layer 16B can have a thickness that is substantially the same as the thickness of the first spacer layer 16A, or the second spacer layer 16B can have a thickness that is greater than or less than the thickness of the first spacer layer 16A.

Figure 2B:
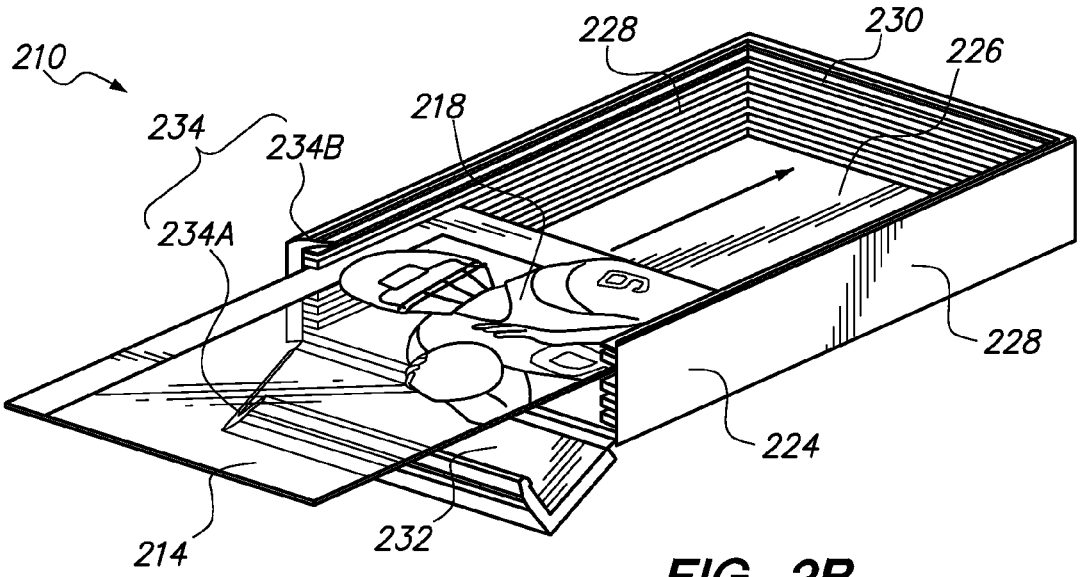
FIG. 2B is a perspective view of a portion of the trading card illustrated in FIG. 2A.
Figure 2A:
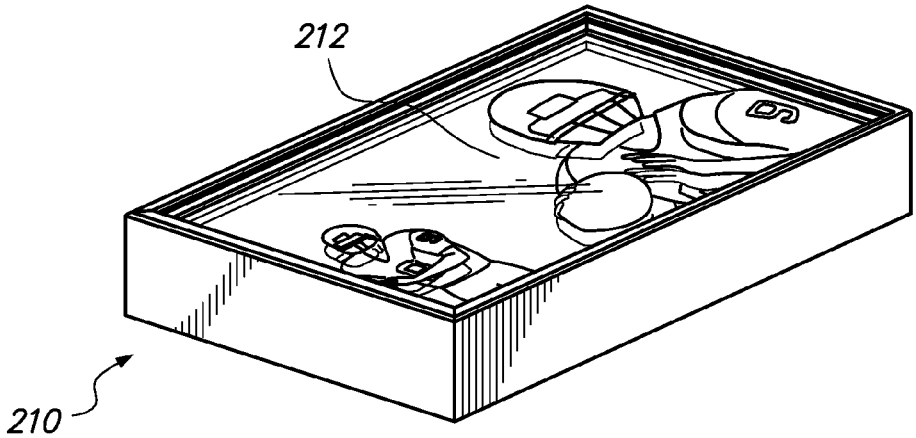
FIG. 2A is a perspective view of another embodiment of a trading card having features of the present invention.

FIG. 2A is a perspective view of another embodiment of a trading card 210 having features of the present invention. The size and shape of the trading card 210 and the various components of the trading card 210 can be varied to suit the desired design requirements of the trading card 210. In this embodiment, the trading card 210 again provides a full card image 212 that includes a plurality of individual card images so as to exhibit increased depth and dimension as compared to a standard trading card.

In some embodiments, the trading card 210 is generally rectangular shaped and has a length of between 2 and 6 inches, a width of between approximately 1.5 and 4.0 inches, and a thickness of between approximately 0.25 and 0.5 inches. For example, the trading card 210 can have the same approximate cross-sectional area of a standard trading card having a length of approximately 3.5 inches, and a width of approximately 2.5 inches. Alternatively, the trading card 10 can have a different shape and/or have a different size. In certain embodiments, for example, the trading card 210 can be generally square shaped, hexagon shaped, octagon shaped, or some other shape, and/or the trading card 210 can have dimensions that are greater than or less than those provided above.

Figure 2E:
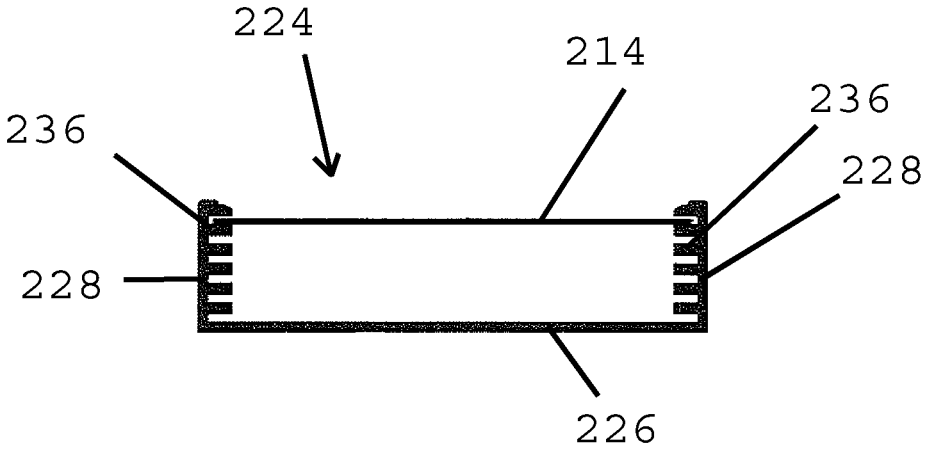
FIG. 2E is a simplified end view of the portion of the box illustrated in FIG. 2C, wherein the box is in an assembled configuration.
Figure 2C:
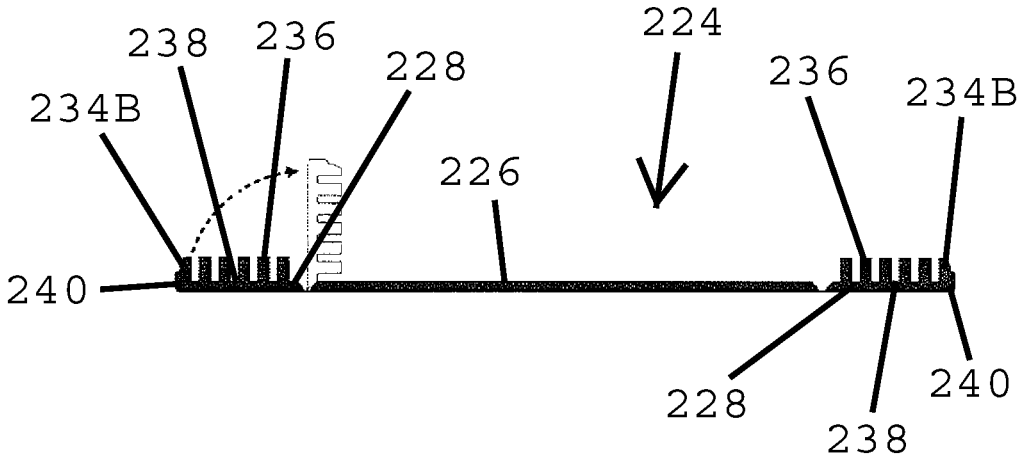
FIG. 2C is a simplified end view of a portion of the box that is part of the trading card illustrated in FIG. 2A, wherein the box is in an unassembled configuration.

FIG. 2B is a partially exploded perspective view of a portion of the trading card 210 illustrated in FIG. 2A. In this embodiment, a plurality of substrates 214 (only one of which is shown in FIG. 2B) are positioned in a box 224 such that each of the substrates 214 are spaced apart from each of the other substrates 214. Uniquely, the box 224 is movable between an unassembled configuration (as illustrated in FIGS. 2C and 2D) and an assembled configuration (as illustrated in FIGS. 2A, 2E and 2F).

Each of the substrates 214 are substantially similar in design to each other and to the substrates 14A, 14B, 14C that were discussed above in relation to the embodiment illustrated in FIGS. 1A and 1B. For example, each of the substrates 214 can be a substantially transparent, generally rectangular shaped substrate that includes a card image 218. The substrates 214 can be made from PVC, clear plastic or some other transparent material. In certain alternative embodiments, one of the substrates 214, i.e. the back substrate or bottom substrate in this particular embodiment, need not be substantially transparent. In one embodiment, the substrates 214 can have the same approximate cross-sectional area of a standard trading card having a length of approximately 3.5 inches, and a width of approximately 2.5 inches. Additionally, the substrates 214 can have a thickness of between approximately 0.5 mm and 1.5 mm. Alternatively, the substrates 214 can have a length, a width and a thickness that are greater than or less than the dimensions listed above, and/or the substrates 214 can have a different shape. In certain embodiments, for example, the substrates 214 can be generally square shaped, hexagon shaped, octagon shaped, or some other shape.

As noted above, each substrate 214 includes a card image 218 that is positioned on the substrate 214. In different embodiments, each card image 218 can cover some, most, or the entire surface of the substrate 214, and can be positioned at any location on the surface of the substrate 214. In certain non-exclusive examples, the card image 218 can include all or a portion of a sports athlete, a celebrity, an entertainer, statistics, a team logo, a game field or arena, an image used in a game, an animated character, an autograph, an animal or landscape. Additionally, in different embodiments, each of the card images 218 can be different than each of the other card images 218, or each of the card images 218 can be substantially similar to one or more of the other card images 218. Still alternatively, in certain non-exclusive examples, the card images 218 can cooperate to form a single combined image, i.e. the full card image 212 (illustrated in FIG. 2A), of a sports athlete, a celebrity, an entertainer, statistics, a team logo, a game field or arena, an image used in a game, an animated character, an autograph, an animal or landscape.

As illustrated in this embodiment, the box 224 includes a base 226, a pair of sides 228, a first end 230, a second end 232, and a latch assembly 234. In this embodiment, each of the sides 228, the first end 230 and the second end 232 are hingably connected to base 226 so that the sides 228, the first end 230 and the second end 232 can pivot relative to the base 226 between the unassembled configuration and the assembled configuration. Alternatively, the sides 228, the first end 230 and the second end 232 can be formed separately from the base 226, and the sides 228, the first end 230 and the second end 232 can be connected to the base 226 in a different manner when the box 224 is being converted into the assembled configuration.

FIG. 2B illustrates the box 224 in a partially assembled configuration wherein the sides 228 and the first end 230 have been moved into the assembled configuration such that they cantilever upward substantially perpendicularly away from the base 226. However, at this point, the second end 232 is still in the unassembled configuration, which allows the substrates 214 to easily be slidingly fitted within the box 224.

The latch assembly 234 functions to maintain the box 224 in the assembled configuration. The design of the latch assembly 234 can be varied to suit the desired design requirements of the box 224 and the trading card 210. In this embodiment, the latch assembly includes a pair of first latch members 234A and a pair of second latch members 234B that selectively engage the first latch members 234A. It should be noted that the use of the terms first latch members and second latch members is merely for reasons of convenience of description, and either of the latch members 234A, 234B can be considered to be first latch members or second latch members.

As noted above, the box 224 is movable between the unassembled configuration (as illustrated in FIGS. 2C and 2D) and the assembled configuration (as illustrated in FIGS. 2E and 2F). While in the unassembled configuration, the box 224 lays substantially flat, with the base 226, the sides 228, the first end 230 and the second end 232 being positioned substantially in the same plane. In the unassembled configuration, the box 224 can be easily packaged and shipped as the box 224 takes up little space. While in the assembled configuration, each of the sides 228, the first end 230 and the second end 232 have been rotated relative to the base 226 so that they cantilever upward substantially perpendicularly away from the base 226. In the assembled configuration, the plurality of substrates 214 can be easily and effectively retained within the box 224.

FIG. 2C is a simplified end view of a portion of the box 224 that is part of the trading card 210 illustrated in FIG. 2A. In particular, FIG. 2C illustrates the base 226 and the sides 228 of the box 224, with the first end 230 and the second end 232 being omitted for purposes of clarity. Moreover, FIG. 2C illustrates the base 226 and the sides 228 of the box 224 in the unassembled configuration. In this embodiment, the base 226 is substantially flat and planar in design, and the sides 228 are hingably connected to the base 226.

As illustrated, while in the unassembled configuration, each of the sides 228 is positioned in substantially the same plane as the base 226 so as to minimize the amount of space taken up by the box 224 when the box 224 is in the unassembled configuration. In this embodiment, each of the sides 228 includes a plurality of spaced apart support ledges 236 and a portion of the latch assembly 234. In particular, each of the sides 228 includes one of the pair of second latch members 234B.

As shown, the support ledges 236 extend substantially perpendicularly away from an inner surface 238 of the sides 228. In this embodiment, each of the sides 228 includes five support ledges 236. Alternatively, the sides 228 can be designed to include more than five or less than five support ledges 236. The second latch member 234B included on each of the sides 228 extends substantially perpendicularly away from the inner surface 238 of the sides 228 near an edge 240 of the sides 228 farthest away from the base 226.

FIG. 2D is a simplified side view of a portion of the box 224 that is part of the trading card 210 illustrated in FIG. 2A. In particular, FIG. 2D illustrates the base 226, the first end 230 and the second end 232 of the box 224, with the sides 228 being omitted for purposes of clarity. Moreover, FIG. 2D illustrates the base 226, the first end 230 and the second end 232 in the unassembled configuration. In this embodiment, the first end 230 and the second end 232 are hingably connected to the base 226.

As illustrated, while in the unassembled configuration, the first end 230 and the second end 232 are positioned in substantially the same plane as the base 226 so as to minimize the amount of space taken up by the box 224 when the box 224 is in the unassembled configuration. In this embodiment, the first end 230 includes a plurality of spaced apart support ledges 236 and a portion of the latch assembly 234. In particular, the first end 230 includes one of the pair of first latch members 234A.

As shown, the support ledges 236 extend substantially perpendicularly away from an inner surface 242 of the first end 230. In this embodiment, the first end 230 includes five support ledges 236. Alternatively, the first end 230 can be designed to include more than five or less than five support ledges 236. Additionally, the first end 230 can be designed to include the same number of support ledges 236 as each of the sides 228. The first latch member 234A included on the first end 230 extends substantially perpendicularly away from the inner surface 242 of the first end 230 near an edge 244 of the first end 230 farthest away from the base 226.

It should be noted that each support ledge 236 of the first end 230 cooperates with one of the support ledges 236 (illustrated in FIG. 2C) of each of the sides 228 (illustrated in FIG. 2C) to form a spacer layer or spacer, similar in function to those shown in the embodiment illustrated in FIGS. 1A and 1B, in order to maintain one of the substrates 214 (illustrated in FIG. 2B) spaced apart from each of the other substrates 214.

In this embodiment, the second end 232 is substantially flat and planar in design and includes a portion of the latch assembly 234. In particular, the second end 232 includes one of the pair of first latch members 234A. The first latch member 234A included on the second end 232 extends substantially perpendicularly away from an inner surface 246 of the second end 232 near an edge 248 of the second end 232 farthest away from the base 226.

Additionally, in one alternative embodiment, the box 224 can be designed so that the second end 232 also includes a plurality of spaced apart support ledges. Still alternatively, the box can be designed so that only one end 230, 232 and only one side 228 include a plurality of spaced apart support ledges, so that only the sides 228 include a plurality of spaced apart support ledges, so that only the ends 230, 232 include a plurality of spaced apart support ledges, or that both ends 230, 232 and only one side 228 include a plurality of spaced apart support ledges. Stated another way, in different embodiments, the box 224 is designed so that at least two of the sides 228 and the ends 230, 232 include a plurality of spaced apart support ledges.

FIG. 2E is a simplified end view of the portion of the box 224 illustrated in FIG. 2C. In particular, FIG. 2E illustrates the base 226 and the sides 228 of the box 224, with the first end 230 and the second end 232 again being omitted for purposes of clarity. Moreover, FIG. 2E illustrates the base 226 and the sides 228 of the box 224 in the assembled configuration. As illustrated, in the assembled configuration, each of the sides 228 has been rotated so that the sides 228 cantilever upward substantially perpendicularly away from the base 226. Additionally, in the assembled configuration, each of the support ledges 236 of each of the sides 228 are adapted to receive and support one of the plurality of substrates 214 and to maintain each of the substrates 214 spaced apart from each of the other substrates 214, and thus, to maintain each of the card images 218 (illustrated in FIG. 2B) spaced apart from each of the other card images 218.

FIG. 2F is a simplified side view 224 of the portion of the box illustrated in FIG. 2D. In particular, FIG. 2F illustrates the base 226, the first end 230 and the second end 232 of the box 224, with the sides 228 again being omitted for purposes of clarity. Moreover, FIG. 2F illustrates the base 226, the first end 230 and the second end 232 of the box 224 in the assembled configuration. As illustrated, in the assembled configuration, the first end 230 and the second end 232 have been rotated so that the first end 230 and the second end 232 cantilever upward substantially perpendicularly away from the base 226. Additionally, in the assembled configuration, each of the support ledges 236 of the first end 230 are adapted to receive and support one of the plurality of substrates 214 and to maintain each of the substrates 214 spaced apart from each of the other substrates 214, and thus, to maintain each of the card images 218 (illustrated in FIG. 2B) spaced apart from each of the other card images 218.

Referring back to FIG. 2B, when in the assembled configuration, the support ledges 236 of each of the sides 228 and the support ledges of the first end 230 cooperate to support the plurality of substrates 214 that may be positioned within the box 224. For example, one support ledge 236 of each of the sides 228 and one support ledge 236 of the first end 230 cooperate to support one substrate 214. In this embodiment, since each of the sides 228 have five support ledges 236 and the first end 230 has five support ledges 236, the support ledges can cooperate to support as many as five substrates 214 spaced apart from each other. Additionally, the base 226 can also support one substrate 214 spaced apart from the substrates 214 that are supported by the support ledges 236. Accordingly, in this embodiment, the box 224 can support as many as six substrates 214 which are spaced apart from each other. In alternative embodiments, the box 224 can be designed to support more than six or less than six substrates 214 that are spaced apart from each other.

Figure 2G:
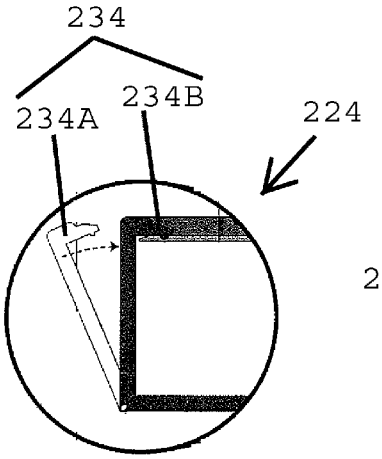
FIG. 2G is a side view of a portion of a latch assembly usable with the present invention.
Figure 2F:
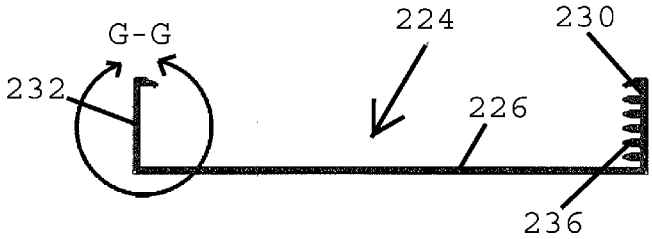
FIG. 2F is a simplified side view of the portion of the box illustrated in FIG. 2D, wherein the box is in the assembled configuration.
Figure 2D:
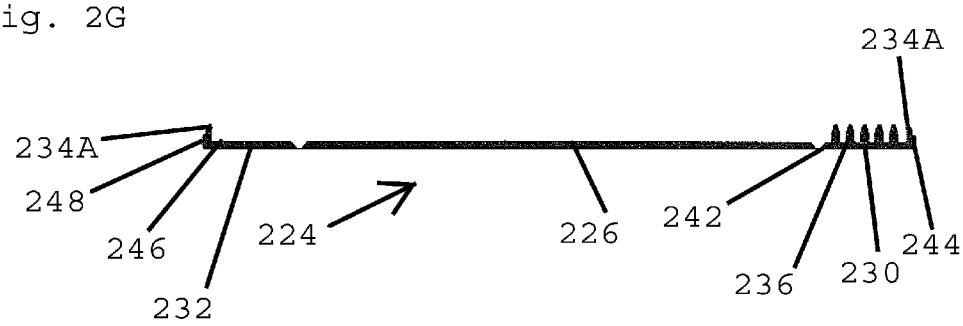
FIG. 2D is a simplified side view of a portion of the box that is part of the trading card illustrated in FIG. 2A, wherein the box is in the unassembled configuration.

FIG. 2G is a side view of a portion of a latch assembly 234 usable with the present invention. As illustrated, during movement of the box 224 from the unassembled configuration to the assembled configuration, each of the first latch members 234A are designed to engage each of the second latch members 234B. In particular, the second latch member 234B included on each of the sides 228 is designed to engage the first latch member 234A that is included on the first end 230 and the first latch member 234A that is included on the second end 232. Somewhat similarly, the first latch member 234A included on the first end 230 is designed to engage the second latch members 234B that are included on each of the sides 228. Still further, the first latch member 234A included on the second end 232 is designed to engage the second latch members 234B that are included on each of the sides 228. Thus, when each of the first latch members 234A are effectively engaged with each of the second latch members 234B, the latch assembly 234 functions to maintain the box 224 in the assembled configuration such that the plurality of substrates 214 can be easily and effectively retained within the box 224.

Figure 3:
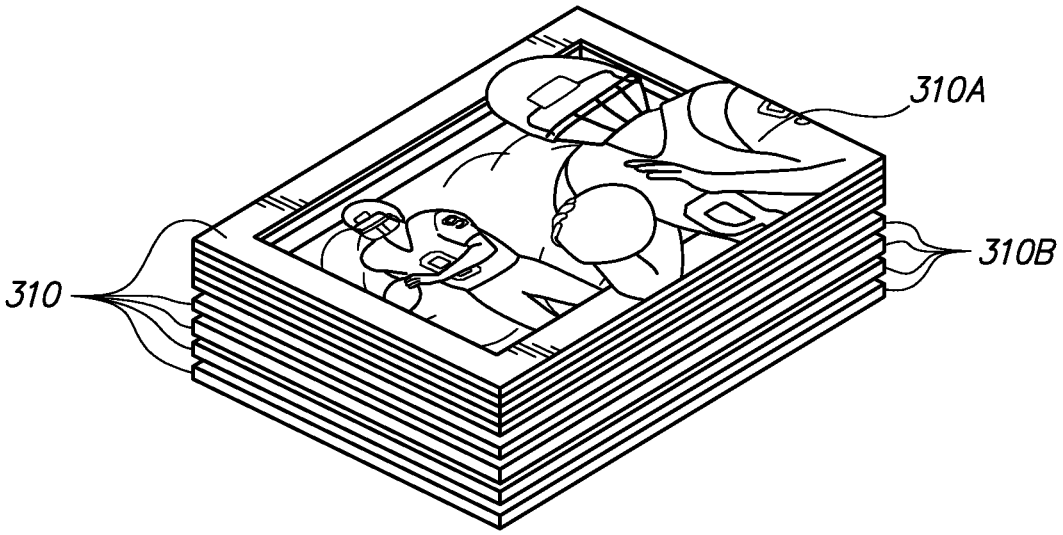
FIG. 3 is a perspective view of a plurality of trading cards that are grouped together for packaging.

FIG. 3 is a perspective view of a plurality of trading cards 310 that are grouped together for packaging. As illustrated in FIG. 3, the plurality of trading cards 310 includes a first trading card 310A having features of the present invention, and a plurality of second trading cards 310B that can have the approximate size and shape of a standard trading card. For example, the plurality of second trading cards 310B can be generally rectangular shaped and have a length of approximately 3.5 inches, a width of approximately 2.5 inches, and a thickness of a thickness of between approximately 0.125 and 0.25 inches.

When packaged together for distribution, the first trading card 310A and the second trading cards 310B are easily grouped together to fit within a standard trading card package (not illustrated). In different embodiments, the package can include one first trading card 310A, or the package can include two or more first trading cards 310A. Additionally, the first trading card(s) 310A can be substantially similar to the trading card 10 as described above in relation to FIGS. 1A and 1B, and/or the first trading card 310A can be substantially similar to the trading card 210 as described above in relation to FIGS. 2A-2G.

While a number of exemplary aspects and embodiments of a trading card 10 have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A trading card having a substantially rectangle-shaped cross-sectional area with a card length of approximately 3.5 inches and a card width of approximately 2.5 inches, the trading card comprising:

a first substrate including a first card image, the first substrate having a substantially rectangle-shaped cross-sectional area with a first length of approximately 3.5 inches and a first width of approximately 2.5 inches;

a second substrate including a second card image, the second substrate being spaced apart from the first substrate, the second substrate having a substantially rectangle-shaped cross-sectional area with a second length of approximately 3.5 inches and a second width of approximately 2.5 inches;

a spacer that is positioned substantially between the first substrate and the second substrate to maintain the first card image spaced apart from the second card image; and a box including a base, a first side, a second side, a first end, and a second end, wherein the first substrate and the second substrate are contained substantially within the box, wherein at least two of the first side, the second side, the first end and the second end include a support ledge, the support ledges cooperating to form the spacer to maintain the first substrate spaced apart from the second substrate, and wherein the first side, the second side, the first end and the second end pivot relative to the base between an unassembled configuration and an assembled configuration.

2. The trading card of claim 1 wherein the first card image and the second card image cooperate to form a full card image.

3. The trading card of claim 1 wherein the first card image is different than the second card image.

4. The trading card of claim 1 further comprising (i) a third substrate including a third card image, the third substrate being spaced apart from the first substrate and the second substrate; and (ii) a second spacer that is positioned substantially between the second substrate and the third substrate to maintain the second card image spaced apart from the third card image.

5. The trading card of claim 4 wherein the first card image, the second card image and the third card image cooperate to form a full card image.

6. The trading card of claim 4 wherein the first card image, the second card image and the third card image are different from one another.

7. The trading card of claim 1 wherein the support ledges are substantially parallel to the base when in the assembled configuration.

8. The trading card of claim 1 wherein the box further includes a latch assembly that maintains the box in the assembled configuration, the latch assembly including a first latch member and a second latch member that selectively engages the first latch member.

9. A method for making a trading card having a substantially rectangle-shaped cross-sectional area with a card length of approximately 3.5 inches and a card width of approximately 2.5 inches, the method comprising the steps of:

providing a first substrate including a first card image, the first substrate having a substantially rectangle-shaped cross-sectional area with a first length of approximately 3.5 inches and a first width of approximately 2.5 inches;

positioning a second substrate spaced apart from the first substrate, the second substrate including a second card image, the second substrate having a substantially rectangle-shaped cross-sectional area with a second length of approximately 3.5 inches and a second width of approximately 2.5 inches;

maintaining the first card image spaced apart from the second card image with a spacer that is positioned substantially between the first substrate and the second substrate;

positioning the first substrate and the second substrate substantially within a box, the box including a base, a first side, a second side, a first end, and a second end, and wherein the step of maintaining includes at least two of the first side, the second side, the first end and the second end include a support ledge, the support ledges cooperating to form the spacer to maintain the first substrate spaced apart from the second substrate; and pivoting the first side, the second side, the first end and the second end relative to the base between an unassembled configuration and an assembled configuration.

10. The method of claim 9 further comprising the step of forming a full card image with the first card image and the second card image.

11. The method of claim 9 further comprising the steps of positioning a third substrate spaced apart from the first substrate and the second substrate, the third substrate including a third card image; and maintaining the second card image spaced apart from the third card image with a second spacer that is positioned substantially between the second substrate and the third substrate.

12. The method of claim 9 wherein the step of maintaining includes the support ledges being substantially parallel to the base when in the assembled configuration.

13. The method of claim 9 further comprising the step of maintaining the box in the assembled configuration with a latch assembly, the latch assembly including a first latch member and a second latch member that selectively engages the first latch member.

14. A trading card comprising:

a first substrate including a first card image;

a second substrate including a second card image, the second substrate being spaced apart from the first substrate;

a spacer that is positioned substantially between the first substrate and the second substrate to maintain the first card image spaced apart from the second card image; and a box including a base, a first side, a second side, a first end, and a second end, wherein the first substrate and the second substrate are contained substantially within the box, wherein the first side, the second side, the first end and the second end pivot relative to the base between an unassembled configuration and an assembled configuration, wherein at least two of the first side, the second side, the first end and the second end include a support ledge, wherein the support ledges cooperate to form the spacer to maintain the first substrate spaced apart from the second substrate, and wherein the support ledges are substantially parallel to the base when in the assembled configuration.

15. The trading card of claim 14 wherein the box further includes a latch assembly that maintains the box in the assembled configuration, the latch assembly including a first latch member and a second latch member that selectively engages the first latch member.

* * * * *